US005178281A

United States Patent [19]

Enzu

[11] Patent Number: 5,178,281

[45] Date of Patent: Jan. 12, 1993

[54] CUSHIONING PACKAGE

[75] Inventor: Masao Enzu, Shizuoka, Japan

[73] Assignee: S. P. Chemical Co., Ltd., Japan

[21] Appl. No.: 822,664

[22] Filed: Jan. 21, 1992

[51] Int. Cl.[5] ..... B65D 81/02

[52] U.S. Cl. ..... 206/522; 137/846; 383/3

[58] Field of Search ..... 137/223, 225, 231, 844, 137/846, 850; 206/522, 521; 251/356, 366; 383/3; 446/220, 224

[56] References Cited

U.S. PATENT DOCUMENTS

| | | | |
|---|---|---|---|
| 4,465,188 | 8/1984 | Soroka et al. | 383/3 |
| 4,705,085 | 11/1987 | Brown | 206/522 |
| 4,708,167 | 11/1987 | Koyanagi | 137/846 |
| 4,758,198 | 7/1988 | Ishiwa | 137/846 |
| 4,874,093 | 10/1989 | Pharo | 206/522 |
| 4,877,334 | 10/1989 | Cope | 383/3 |
| 4,917,646 | 4/1990 | Kieves | 137/846 |

FOREIGN PATENT DOCUMENTS

| | | | |
|---|---|---|---|
| 2218401 | 11/1989 | United Kingdom | 206/522 |

*Primary Examiner*—Jimmy G. Foster

[57] ABSTRACT

A cushioning package includes a barrel-shaped balloon body consisting of outer film formed of a material having no air-permeability and an inner film that is substantially similar in shape to the outer film and is formed of a material having no air-permeability and is placed on the inside of the outer film, the films being bonded together at the upper and lower edges such that an amount of air can be fed therebetween, and includes a check valve attached to the balloon body and formed by superposing two film pieces having no air-permeability one upon another and bonding them together along two linear seals, one of the linear seals extending at its lower end at an angle of 45° or more with respect to the other linear seal and terminates at a position spaced several to a few tens mm space away from the linear seal, leaving an unbonded portion serving as an air passage.

2 Claims, 3 Drawing Sheets

CUSHIONING PACKAGE

BACKGROUND OF THE INVENTION

1. Field of the Invention

This invention relates to a one-way form of barrel-shaped, balloon cushioning package that is particularly characterized by including an air inlet defined by a check valve formed by superposing two film pieces one upon another and bonding them together along two bonding lines.

2. Prior Art

When an article is likely to be deformed or damaged by contacting or colliding with another article, handling means, etc. during delivery, transportation or other handling, it is packaged in a double walled bag package that is made up of outer and inner films and can be inflated by admitting air between them.

When placed in this package, the article is surrounded with an air layer which prevents it from contacting or colliding with another article, etc. and absorbs external force applied to it, thereby preventing it from being damaged or otherwise deformed. In this regard, see U.S. Pat. Nos. 4,155,453 and 4,240,556 specifications, for instance.

After the above conventional bag package has been loaded with the article, it is inflated to an internal pressure of 1 atmosphere or more by feeding an amount of air into it, so that the inner film can bear on the article to fix the article centrally in the bag package; that is, the article can apparently be made integral with the bag package, so that any incident forces cannot be applied on the article, making its delivery, transportation and handling easy.

However, a grave problem with such a conventional bag package is that the air inlet is made of a material different from that forming the outer film and extends slightly beyond the outer film; when the package is inflated to a given internal pressure by feeding an amount of air into it, it is most unlikely to tear up or otherwise cause damage to the outer film of other package, such as when it is placed in a container for transportation.

Mounting air inlets to bag packages is not only troublesome but needs a number of steps as well.

It is thus an object of this invention to provide a cushioning package which provides an improved sealing to an article to be loaded in it and includes a check valve designed to be apparently made integral with an outer film.

SUMMARY OF THE INVENTION

According to this invention, the above object is achieved by the provision of a cushioning package provided with an air inlet defined by a check valve, said check valve being formed by superimposing two film components having no air-permeability one upon another and bonding them together along two linear seals, and one of said linear seals extending at its lower end at an angle of 45° or more with respect to the other linear seal and terminating at a position spaced several to a few tenths of a mm away from the other linear seal, leaving an unbonded portion which serves as an air passage.

The package body of the cushioning package may be formed by folding over a barrel-shaped film twice as long, thereby forming outer and inner films.

BRIEF DESCRIPTION OF THE DRAWINGS

This invention will now be explained more specifically but not exclusively with reference to the accompanying drawings, in which.

DESCRIPTION OF THE PREFERRED EMBODIMENTS

As illustrated, a cushioning package according to this invention is made up of a barrel-shaped, balloon body 1 and a check valve 2 attached to an upper edge thereof, said check valve also serving as an air inlet.

The balloon body 1 consists of an outer film 11 formed of a material possessing no air-permeability such as polyethylene and an inner film 12 which is substantially similar in shape to the outer film and is again formed of a material that possesses no air-permeability. The inner film 12 is superimposed on the inside of the outer film 11, and both films are bonded together at their upper and lower edges in such a manner that they can be inflated, by insertion of air in an annular space there between.

Figure 5:
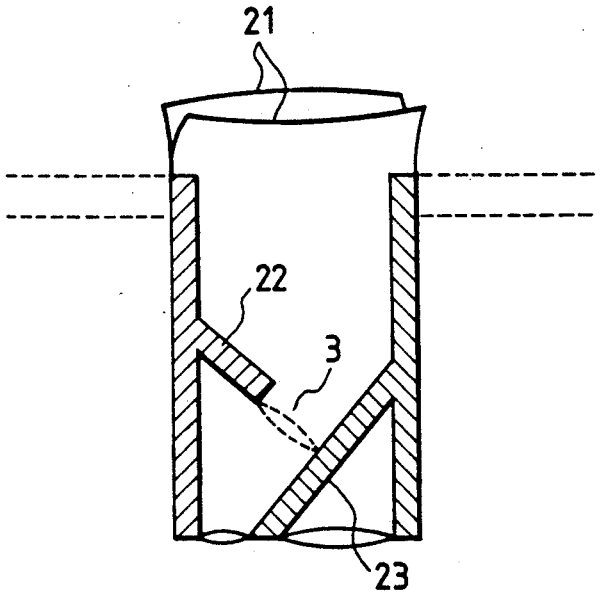
FIG. 5 is a perspective view of one example of the check valve.
Figure 6:
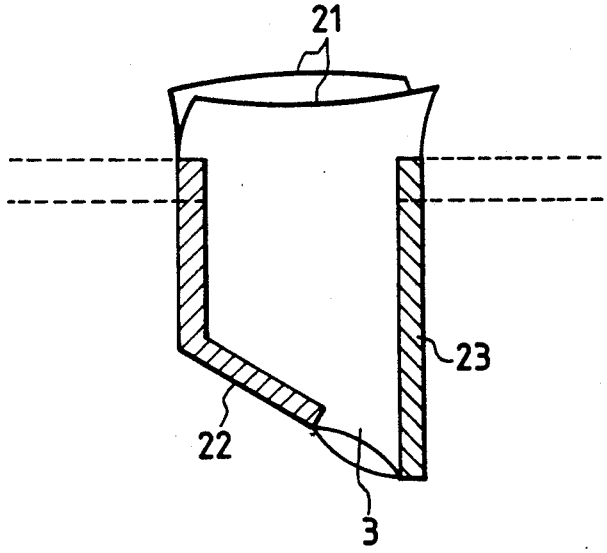
FIG. 6 is a perspective view of another embodiment of the check valve.

The check valve 2 consists of two valve film pieces 21, which are superimposed on upon another and bonded together along two linear seals 22 and 23 by suitable bonding means such as heat bonding or high-frequency heating. In the illustrated embodiment of the check valve 2, one linear seal 22 extends at its lower end at an angle of 45° or more with respect to the other linear seal 23, and terminates at a position spaced several to a few tenths of a mm from the other linear seal 23, leaving a gap 3 serving as an air passage, as can be best seen from FIGS. 5 or 6.

In order to attach the check valve 2 to the body 1, it may be inserted between the outer and inner films 11 and 12 and bonded to the upper edges thereof, when the both films are bonded together at the upper edges.

For instance, the associated faces of the outer and inner films 11 and 12 may be each formed of a heat-bondable film, and the outer face of the film piece 21 of the check valve 2 may be formed of a heat-bondable film. Then, the check valve 2 is inserted between the upper edges of the outer and inner films 11 and 12, followed by heat bonding.

As a result, the upper edges of the outer and inner films 11 and 12 are heat-bonded together directly where the check valve 2 is not inserted and they are heat-bonded together respectively to the outer face of the film 21 where the check valve 2 is inserted. In this way, the check valve 2 is attached to the balloon body 1.

While the check valve 2 need not extend beyond the upper edge of the cushioning package, it is understood that extending unbonded upper edges of the check valve beyond the upper edge of the cushioning helps make the insertion of an air blower valve easy.

Figure 2:
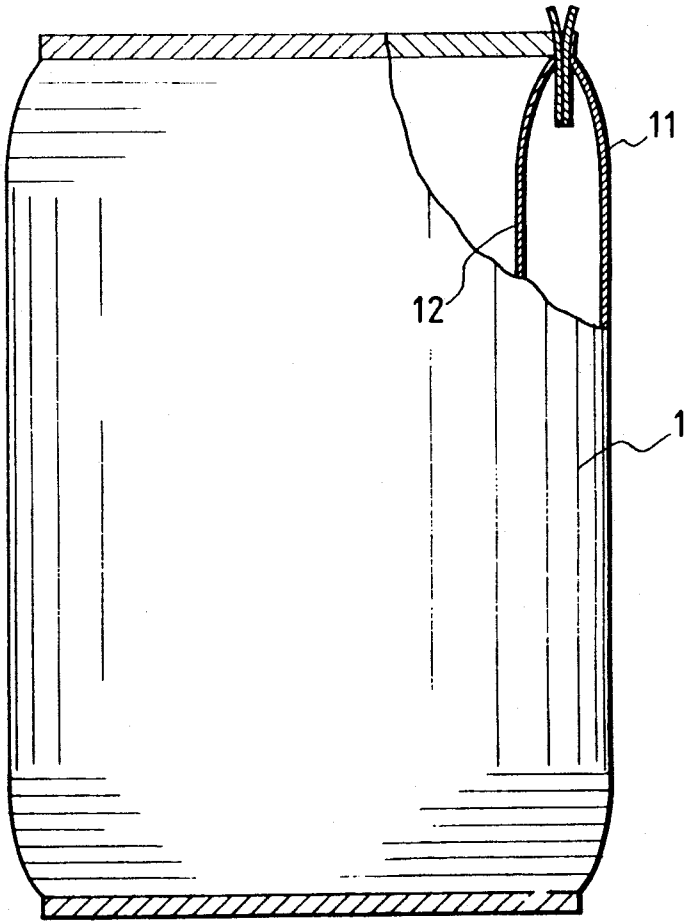
FIG. 2 is a partly cut-away front view of that embodiment.
Figure 1:
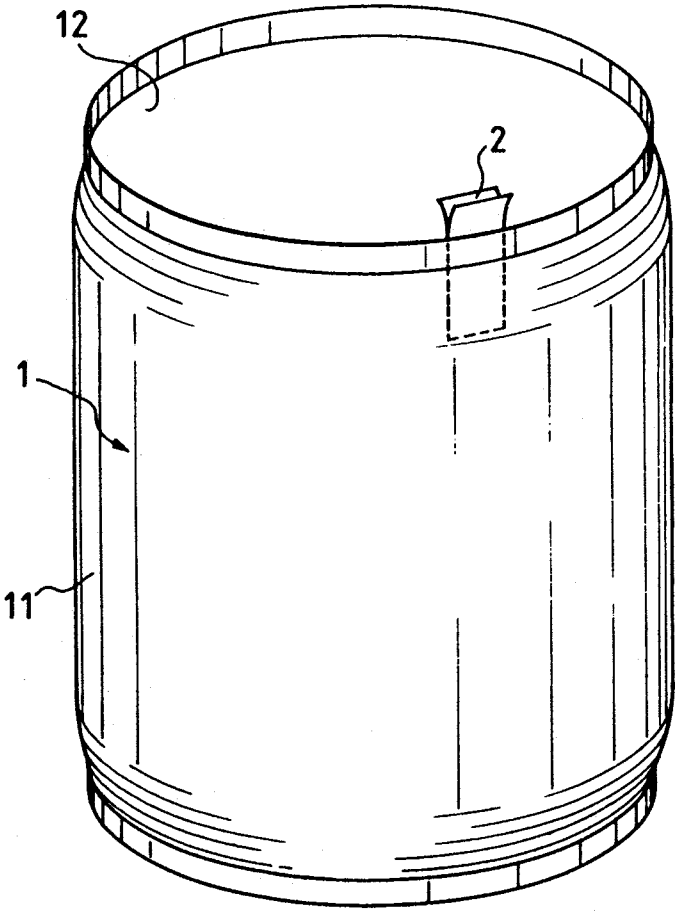
FIG. 1 is a perspective view showing one embodiment of the cushioning package according to this invention.
Figure 3:
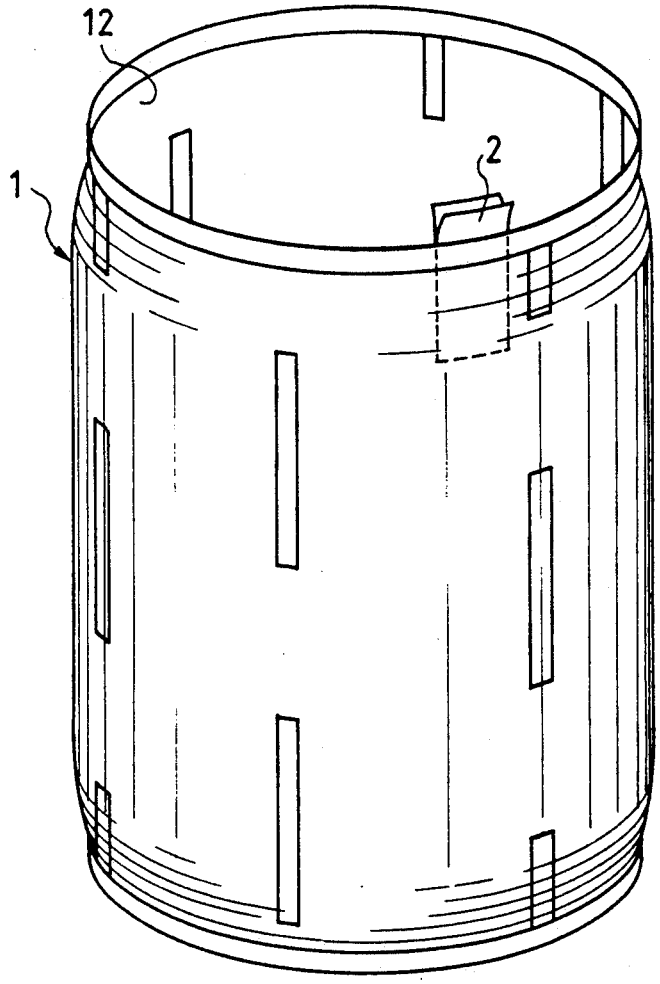
FIG. 3 is a perspective view of one embodiment of the cushioning package with the outer and inner films being bonded together at several regions.
Figure 4:
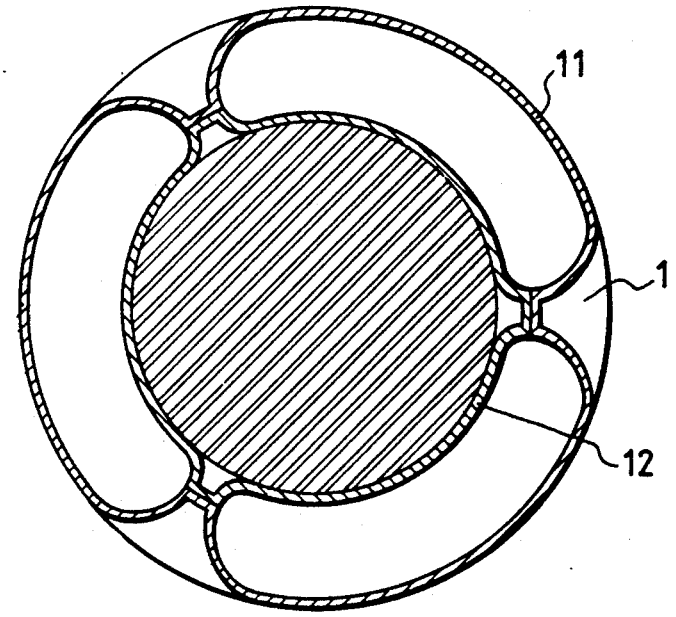
FIG. 4 is a cross-sectional plan view of that embodiment in use.

FIG. 3 shows another embodiment of the cushioning package in which the outer and inner films 11 and 12 of the balloon body 1 are bonded together at several regions. With this embodiment, when the cushioning package is inflated, the outer film 11 is prevented from bulging excessively, so that the apparent thickness of the cushioning package can be limited.

According to the cushioning package of this invention wherein the check valve formed by superimposed two film pieces showing no air-permeability one upon another serves as an air inlet, as described above, it can be folded or handled with no difficulty.

In addition, this check valve is most unlikely to cause damage to other cushioning package, because it does not extend beyond the cushioning package when it is inflated.

Further, this check valve provides a greatly improved sealing to the article loaded in the cushioning package, because it is formed by superposing two film pieces showing no air-permeability one upon another and bonding them together along two linear seals by bonding means such as heat bonding or high-frequency heating and on account of the arrangement that one linear seal extends at its lower end at an angle of 45° or more with respect to the other linear seal.

Still further, the check valve, because of being formed by superposing two film pieces having no air-permeability one upon another, can be attached to the balloon body simultaneously when the outer and inner films thereof are bonded together at the upper edges, making the production of cushioning packages considerably easy.

What is claimed is:

1. An inflatable packaging structure comprising a barrel-shaped tubular body comprising an outer air-impermeable film layer and an inner air-impermeable film layer, said films bonded along opposing edges thereof to form an annular space therebetween, said structure further including check-valve means permitting air to be fed to said annular space, said check valve means formed by superimposing two air-impermeable film members one upon the other, opposing lateral edges of said film members being sealed to form an air passage between said film members to permit passage of air therebetween into said structure, said air passage being further defined by an oblique seal extending from one sealed lateral edge toward an opposing sealed lateral edge and defining an angle of at least 45° therebetween, said oblique seal terminating at a point spaced from said opposing sealed lateral edge to define an exit passage for air into said packaging structure.

2. The structure of claim 1, wherein said check-valve means further includes a second oblique seal, each of said oblique seals being oriented perpendicular to one another within said check-valve means, and said air passage extending between said oblique seals.

* * * * *